United States Patent [19]

Vinzant et al.

[11] Patent Number: 4,834,183

[45] Date of Patent: May 30, 1989

[54] SURFACE CONTROLLED SUBSURFACE SAFETY VALVE

[75] Inventors: Michael B. Vinzant; Craig D. Hines; Rennie L. Dickson, all of Carrollton; Robert C. Hammett, Garland, all of Tex.

[73] Assignee: Otis Engineering Corporation, Dallas, Tex.

[21] Appl. No.: 155,980

[22] Filed: Feb. 16, 1988

[51] Int. Cl.[4] ..... E21B 34/10

[52] U.S. Cl. ..... 166/332; 166/321; 251/89

[58] Field of Search ..... 166/332, 320, 321, 323, 166/325, 375; 251/58, 89

[56] References Cited

U.S. PATENT DOCUMENTS

| | | | |
|---|---|---|---|
| 3,731,742 | 5/1973 | Sizer et al. | 166/315 |
| 3,860,066 | 1/1975 | Pearce et al. | 116/72 |
| 3,882,935 | 5/1975 | Calhoun | 166/323 |
| 3,886,967 | 6/1975 | Nelson | 251/89 |
| 4,002,202 | 1/1977 | Huebsch et al. | 166/65 M |
| 4,201,363 | 5/1980 | Arendt et al. | 251/62 |
| 4,344,602 | 8/1982 | Arendt | 166/323 |
| 4,356,867 | 11/1982 | Carmody | 166/373 |
| 4,428,557 | 1/1984 | Yonker et al. | 251/62 |
| 4,449,587 | 5/1984 | Rodenberger et al. | 166/323 |
| 4,513,944 | 4/1985 | Adams, Jr. | 251/89 |
| 4,624,315 | 11/1986 | Dickson et al. | 166/323 |
| 4,691,776 | 9/1987 | Pringle | 166/332 |
| 4,703,805 | 11/1987 | Morris | 166/332 |
| 4,723,606 | 2/1988 | Vinzant et al. | 166/319 |

*Primary Examiner*—Jerome W. Massie
*Assistant Examiner*—Terry Lee Melius
*Attorney, Agent, or Firm*—Thomas R. Felger

[57] ABSTRACT

A surface controlled subsurface safety valve for use in a well tubing string including a valve closure member, an operator tube for opening the valve closure member, an annular piston on the operator tube responsive to control fluid pressure conducted from the well surface, and a spring biasing the operator tube to a position closing the valve. A lockout sleeve mounted in tandem with the operator tube for movement to a position in which the lockout sleeve holds the valve open. The operator tube having multiple flow paths and barriers to prevent accumulation of debris from well fluids within the safety valve. One flow path including a plurality of small ports extending through the upper portion of the operator tube. Another flow path defined in part by a reduced outside diameter portion of the operator tube near its lower end and multiple channels in the valve housing adjacent thereto.

19 Claims, 4 Drawing Sheets

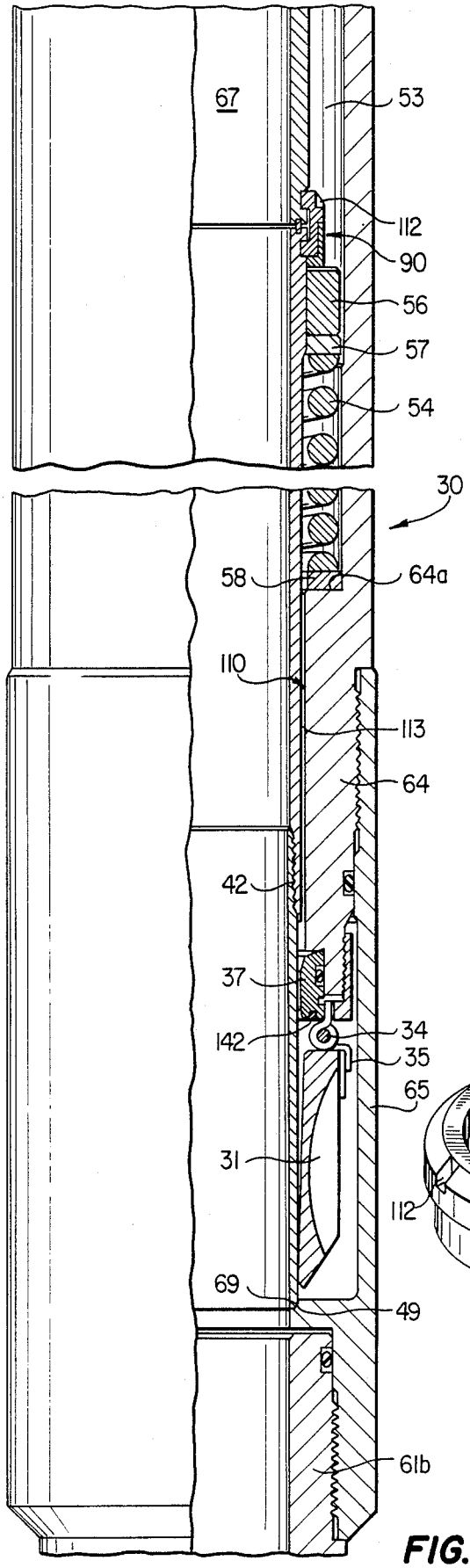
FIG. 8
FIG. 9
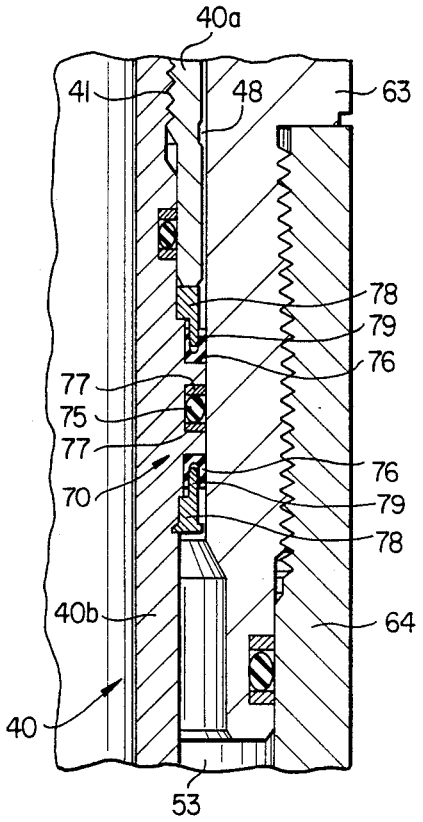
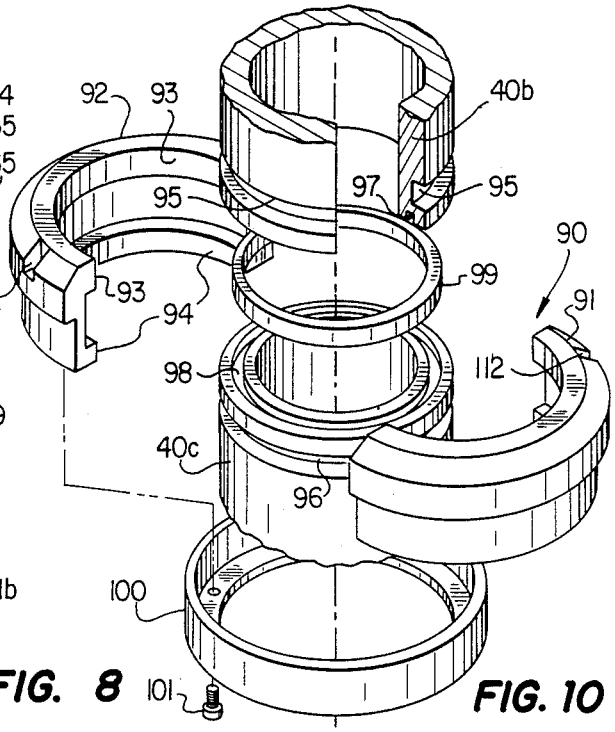
FIG. 10

SURFACE CONTROLLED SUBSURFACE SAFETY VALVE

BACKGROUND OF THE INVENTION

This invention relates to surface controlled subsurface safety valves used in the oil and gas industry and particularly to downhole safety valves used in well completions having a tendency to produce sand or other debris.

DESCRIPTION OF RELATED ART

It is common practice to complete oil and gas producing wells with safety systems including a subsurface safety valve controlled from the well surface to shut off fluid flow in the well tubing string. Generally such a valve is controlled in response to control fluid pressure conducted to the valve from a remote location at the well surface via a small diameter conduit permitting the well to be selectively shut in as well conditions require. However, the present invention is not limited to use with safety valves that respond only to fluid pressure signals. The surface controller is typically equipped to respond to emergency conditions such as fire, broken flow lines, oil spills, etc. Frequently it is necessary to conduct well servicing operations through a subsurface safety valve. The well servicing operation may require extending a wireline tool string through the subsurface safety valve. Examples of such services are pressure and temperature testing. Additional well servicing procedures are required to retrieve damaged downhole equipment. These procedures result in periodic opening and closing of the safety valve. Subsurface safety valves are shown in the following U.S. Pat. Nos. 3,860,066; 3,882,935; 4,344,602; 4,356,867; and 4,449,587. The present invention particularly relates to a subsurface safety valve of the type shown in U.S. Pat. Nos. 4,624,315 and 4,723,606 employing a flapper type of valve closure in the subsurface safety valve. However, U.S. Pat. No. 3,860,066 teaches that a longitudinally movable operator tube may control the opening and closing of ball, poppet, or flapper type valve closure means within a subsurface safety valve. U.S. Pat. Nos. 4,201,363 and 4,428,557 teach the use of felt wipers to prevent sand or similar debris from accumulating in the spring chamber of a subsurface safety valve. U.S. Pat. No. 4,201,363 shows in FIGS. 2C and 3C a releasable coupling between control tube sections **46*a* and 46*b***. The previously listed patents are incorporated by reference for all purposes in this application.

SUMMARY OF THE INVENTION

The present invention relates primarily to tubing retrievable safety valves having a housing connectable with a well tubing string and a bore therethrough for communicating well fluid flow with the tubing string, a valve closure means mounted in the housing for movement between a first open position and a second closed position, and an operator tube in the housing to control movement of the valve closure means between its first position and its second position. The operator tube normally moves in response to a control signal from the well surface and a spring biasing the operator tube. A lockout sleeve may be mounted in the housing in tandem with the operator tube to hold open the valve closure means. Since a tubing retrievable safety valve cannot be easily removed from the well bore for routine maintenance, any accumulation of debris or deposits within the safety valve can be very expensive to clean out. Portions of all safety valves are subject to debris accumulation particularly in regions with stagnate or reduced well fluid flow rates. The present invention minimizes the possibility for accumulation of debris by:

creating turbulent flow within portions of the housing, establishing a fluid barrier to some portions of the housing, and providing a flow path to discharge any debris accumulated in other portions of the housing.

The net result is a subsurface safety valve with increased downhole service life even though the well fluids flowing therethrough may contain sand, paraffin, calcium, or other materials.

The outside diameter of the operator tube is slightly smaller than the inside diameter of the housing means adjacent thereto. This difference in diameters allows the operator tube to slide longitudinally within the housing means. The difference in diameters creates an annular space which has a tendency to accumulate sand or other debris carried by well fluids. If such deposits are allowed to accumulate in the annular space, they may prevent satisfactory functioning of the safety valve.

It is a principal object of the present invention to provide a subsurface safety valve for use in oil and gas wells which minimizes the possibility for sand or other debris to accumulate and prevent proper functioning of the safety valve.

It is another object of the invention to provide a subsurface safety valve having an operator tube with one or more small ports or flow nozzles near its upper end to prevent accumulation of debris on top of the operator tube.

It is another object of the invention to provide a subsurface safety valve having an operator tube with two or more sections and a union connecting the sections to prevent undesired fluid flow therebetween.

It is another object of the invention to provide a subsurface safety valve including flow channels to flush sand or other debris from the annular space during movement of the operator tube.

It is another object of the invention to provide a subsurface safety valve having an operator tube with improved piston means.

Additional objects and advantages of the present invention will be apparent to those skilled in the art from studying the following detailed description in conjunction with the accompanying drawings in which several preferred embodiments of the invention are shown.

BRIEF DESCRIPTION OF THE DRAWINGS

FIG. 8 is a view similar to FIG. 2B showing the valve closure means in its first, open position.

FIG. 9 is an enlarged view in section with portions broken away showing improved piston means carried on the operator tube.

FIG. 10 is a drawing in elevation with portions broken away showing the components of a flexible coupling used to join two sections of the operator tube.

DESCRIPTION OF THE PREFERRED EMBODIMENT

Figure 1:
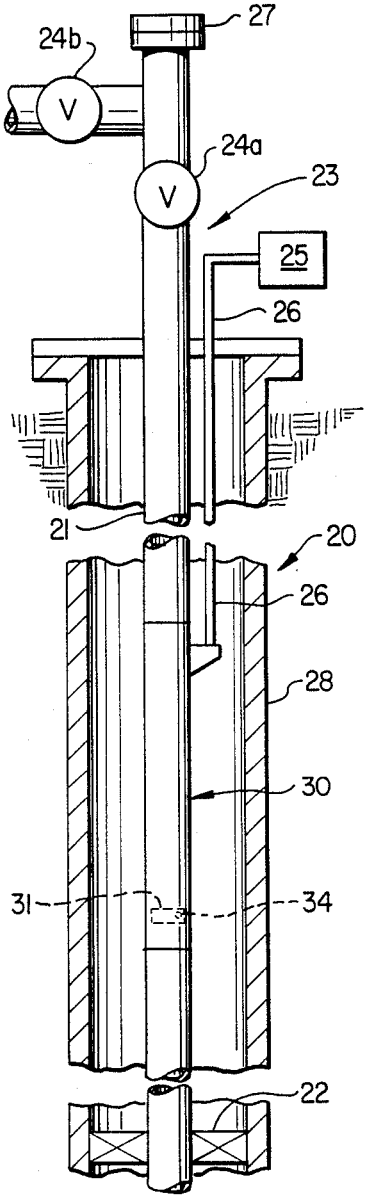
FIG. 1 is a schematic view in section and elevation of a typical well completion including a tubing retrievable subsurface safety valve with a flapper type valve closure means.

Referring to FIG. 1, well completion 20 includes casing string 28 extending from the well surface to a hydrocarbon producing formation (not shown). Tubing string 21 is concentrically disposed within casing 28 and extends from wellhead 23 through production packer 22 which seals between tubing string 21 and casing 28. Packer 22 directs formation fluids such as oil, gas, water, and the like into tubing string 21 from perforations (not shown) in casing 28 which admit formation or well fluids into the well bore. Well fluids frequently carry sand or other debris which may accumulate at locations in tubing string 21 having low fluid velocity. Flow control valves 24*a* and 24*b* at the well surface control fluid flow from tubing string 21. Wellhead cap 27 is provided on wellhead 23 to permit servicing well 20 via tubing string 21 by wireline techniques which include the installation and removal of various downhole tools (not shown) within tubing string 21. Other well servicing operations which may be carried out through tubing string 21 are bottom hole temperature and pressure surveys.

Surface controlled subsurface safety valve 30 embodying the features of the invention is installed in well completion 20 as a part of tubing string 21 to control fluid flow to the well surface via tubing string 21 from a downhole location. Safety valve 30 is operated by control fluid conducted from hydraulic manifold 25 at the well surface via control line conduit 26 which directs the control fluid signal to safety valve 30. Hydraulic manifold 25 generally includes pumps, a fluid reservoir, accumulators, and control valves for the purpose of providing control fluid pressure signals for holding valve 30 open or allowing valve 30 to close when desired. Manifold 25 also includes apparatus which functions in response to temperature, surface line leaks, and other emergency conditions under which well 20 should be shut in.

Safety valve 30 includes flapper type valve closure means 31 mounted on hinge 34 for swinging between its closed position schematically represented in FIG. 1 and open position in FIG. 8 which permits fluid flow in tubing string 21. When a predetermined pressure signal is applied to safety valve 30 through control line 26 from manifold 25, valve closure means or flapper 31 is maintained in its first or open position. When the control pressure signal is released, valve 30 is allowed to move to its second or closed position.

Figure 2A:
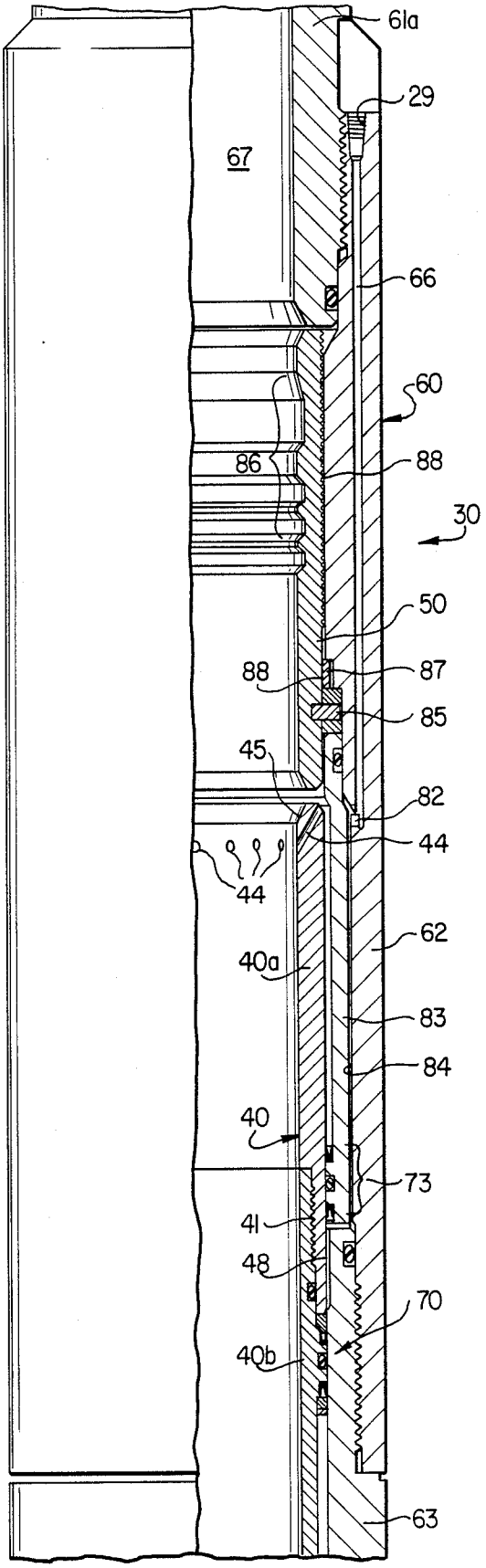
FIGS. 2A and 2B taken together form a longitudinal view in section and elevation with portions broken away of a subsurface safety valve and operator tube incorporating the present invention showing the safety valve in its closed position (dotted line open position).
Figure 2B:
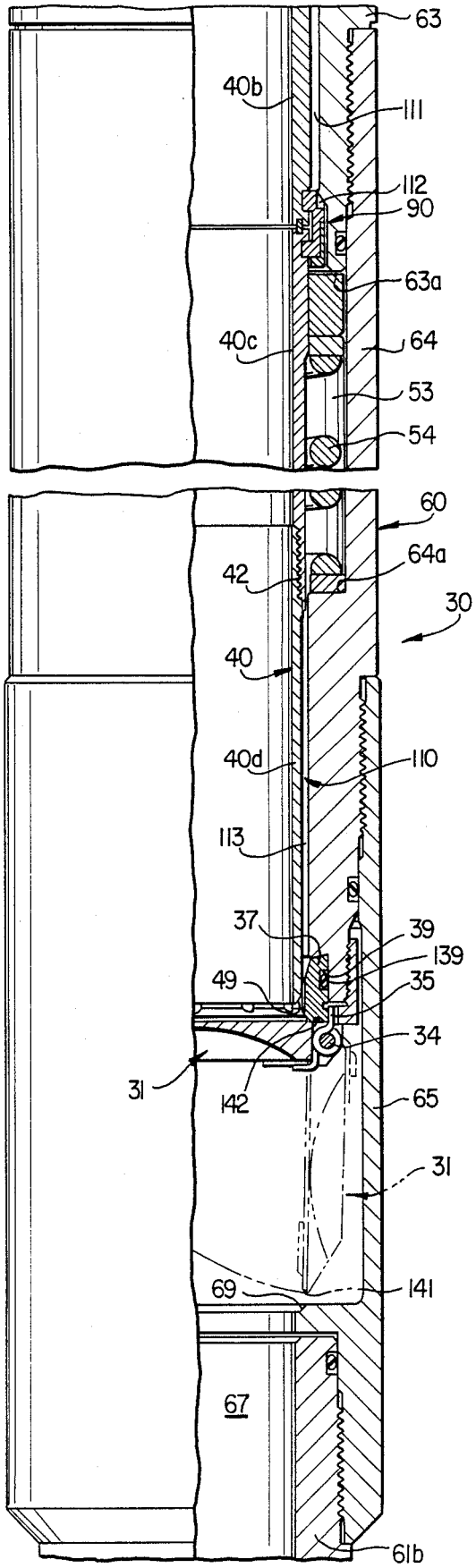

Details of the construction of the preferred form of valve 30 are shown in FIGS. 2A and 2B. Subsurface safety valve 30 has housing means 60 formed by a top sub 61*a*, a bottom sub 61*b*, and housing subassemblies 62, 63, 64, and 65 which are suitably interconnected by threaded joints as illustrated. Housing means 60 can be generally described as a long thick-walled cylinder with longitudinal bore 67 extending therethrough. Top and bottom subs 61*a* and 61*b* may be internally or externally threaded to provide means on opposite ends of housing means 60 for connection with tubing string 21.

Housing subassembly 62 has threaded connection 29 to allow attaching control line 26 to safety valve 30. Control fluid pressure signals are communicated from the well surface via control line 26, threaded connection 29, drilled passageway 66, and opening 82 to longitudinal bore 67. Cylinder 83 is positioned within longitudinal bore 67 adjacent to opening 82. During normal operation of safety valve 30, control fluid pressure signals are directed to operator tube 40 via annular passageway 84 formed between the inside diameter of housing subassembly 62 and the outside diameter of cylinder 83.

Lockout sleeve 50, slidably disposed within longitudinal bore 67, is provided in valve 30 for movement from its first position in which valve closure means 31 is free to open or close and a second position (not shown) which holds valve closure means 31 open. Lockout sleeve 50 is sized to fit concentrically within housing subassembly 62 and cylinder 83. During normal operation of safety valve 30, shear pin 85 holds lockout sleeve 50 in its first or inactive position shown in FIG. 2A. If safety valve 30 should become inoperative, profile or locking recesses 86 on the inside diameter of lockout sleeve 50 can be engaged by a suitable shifting tool (not shown) to force sleeve 50 into abutting contact with operator tube 40 and to open safety valve 30. Latch ring 87 is carried by housing subassembly 62 within longitudinal bore 67 to hold lockout sleeve 50 in place after it has moved to its second position (not shown). Matching teeth 88 are carried on the outside diameter of sleeve 50 and the inside diameter of latch ring 87. The use of locking recesses 86 and lockout sleeve 50 to permanently lock open safety valve 30 is well known in the art.

Operator tube 40 is slidably disposed within longitudinal bore 67 to shift valve closure means 31 from its second, closed position as shown in FIG. 2B to its first, open position as shown in FIG. 8. For ease of manufacture and assembly, operator tube 40 is constructed from two or more generally hollow, cylindrical sections designated 40*a–d*. Sections 40*a* and 40*b* are joined together by threads 41. Sections 40*c* and 40*d* are joined together by threads 42. Piston seal means 70 are carried on the exterior of operator tube 40 to form a sliding fluid barrier with the inside diameter of housing subassembly 63 adjacent thereto. Stationary seal means 73 are carried by cylinder 83 to form a fluid barrier with the exterior of operator tube section 40*a*. Stationary seal means 73, movable piston seal means 70, and the exterior of operator tube 40 therebetween define in part variable volume control fluid chamber 48. Control fluid pressure from annular passageway 84 is received within chamber 48 to act upon piston seal means 70 and to longitudinally slide operator tube 40 towards valve closure means 31. Biasing means or spring 54 is carried on the exterior of operator tube 40 in spring chamber 53 defined in part by shoulder 63*a*, shoulder 64*a*, and the inside diameter of housing subassembly 64. Biasing means 54 applies a force to slide operator tube 40 longitudinally opposite from the force of control fluid pressure in chamber 48 acting on piston seal means 70. When control fluid pressure in chamber 48 is decreased below a preselected value, spring 54 moves operator tube 40 longitudinally upward to allow valve closure means 31 to return to its second, closed position. Spring 35 coiled around hinge 34 assists in moving flapper 31 to its closed position.

Figure 4:
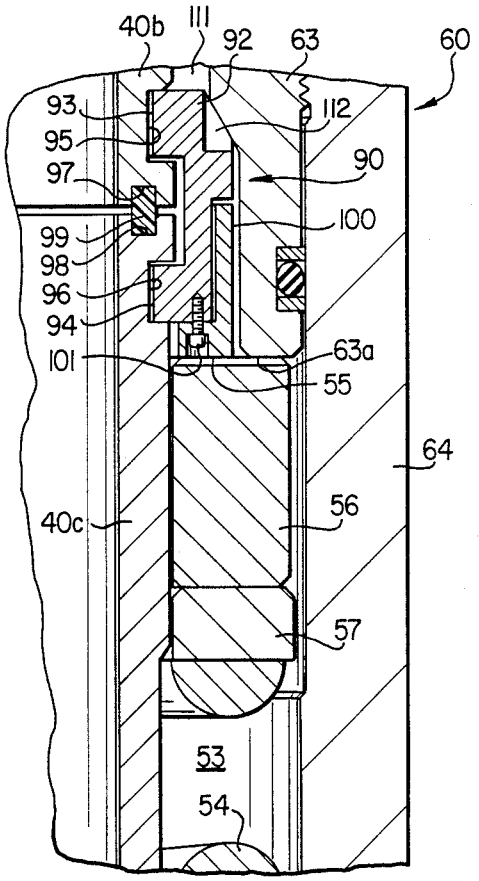
FIG. 4 is an enlarged drawing in section with portions broken away of one embodiment of the flexible coupling of the present invention.

If desired, operator tube 40 could be machined from a single piece of raw material or sections **40*b* and 40*c* joined together by threads similar to threads 41 and 42. However, such construction requires adherence to many close tolerances for proper functioning of operator tube 40 within longitudinal bore 67. Also during slam closure of flapper 31, operator tube 40 and piston seal means 70 may be damaged by high stress loading. Operator tube 40 as shown in FIGS. 2A and 2B compensates for variations in manufacturing tolerances and provides for easier assembly by using flexible coupling or connecting means 90. Flexible coupling 90 also compensates for slam closure forces. As best shown in FIGS. 4 and 10, flexible coupling 90 comprises two split rings 91 and 92. Each split ring 91 and 92 has a pair of inwardly facing flanges 93 and 94 that engage matching grooves 95 and 96 on operator tube sections 40*b* and 40*c* respectively. Recesses 97 and 98 are machined into the extreme lower end of sections 40*b* and 40*c*, respectively, facing each other. Sand barrier ring 99 fits within recesses 97 and 98 between sections 40*b* and 40*c*. During assembly, ring 99 is inserted into recess 97. Section 40*c* is then positioned adjacent to and aligned with section 40*b* with ring 99 partially disposed in recess 98. Split rings 91 and 92 are next engaged with grooves 95 and 96. Split rings 91 and 92 cause operating tube sections 40*b* and 40*c* to move together in unison within longitudinal bore 67 while allowing limited flexing to compensate for minor variations in dimensional tolerances between operator tube 40 and the interior of housing means 60. Retainer ring 100 is sized to slide over the exterior of operator tube sections 40*c* and 40*d* and to securely engage split rings 91 and 92 with each other. Screw 101 is used to attach retainer ring 100 to split ring 92. Sand barrier ring 99 restricts fluid flow between the adjacent ends of sections 40*b* and 40*c*. Ring 99 can be manufactured from a wide variety of elastomers and copolymers. Teflon® based material has proven satisfactory for ring 99. During slam closure of flapper 31, high stress forces are applied to operator tube section 40*d* and via threads 42 to section 40*c*. Flexible coupling 90 does not transfer all of these stress forces to operator tube sections 40*b* and 40*c*. By absorbing some stress forces, flexible coupling 90 adds to the service life of piston seal means 70**.

In addition to connecting sections **40*b* and 40*c*, connecting means 90 also provides means for spring 54 to engage operator tube 40. As shown in FIGS. 4 and 8, connecting means 90 has a larger outside diameter than other portions of operator tube 40. The lower end of retainer ring 100 provides shoulder 55 on the exterior of operator tube 40. Spacer rings 56 and 57 are carried on the exterior of operator tube 40 and abut shoulder 55. One end of spring 54 abuts spacer ring 57. A similar spacer ring 58 rests on shoulder 64*a* and is contacted by the other end of spring 54. The size and number of spacers 56, 57 and 58 can be varied to adjust the force of spring 54 acting on operator tube 40**.

Piston seal means 70 as best shown in FIG. 9 has several separate elements including O-ring seal 75 and U-shaped cup seals 76 on either side thereof. Backup rings 77 are provided on either side of O-ring seal 75 to prevent extrusion thereof. Non-elastomer rings 78 are carried on piston means 70 adjacent to each cup seal 76. Rings 78 include extension 79 which projects into its respective cup seal 76. Extension 79 prevents rolling of the associated cup seal 76 during longitudinal movement of operator tube 40. Rings 78 are preferably made from non-elastomeric material. However, soft metal rings could also be used. Cup seals satisfactory for use with the present invention can be obtained from American Variseal Corporation. O-ring seal 75 is used to provide a fluid type seal at low pressures. Cup seals 76 are effective at higher pressures. The combination of O-ring seal 75 and cup seals 76 reduces friction forces during movement of operator tube 40. Cup seals 76 also protect O-ring seal 75 from sand or other debris. Stationary seal means 73 has components similar to piston seal means 70 except rings 78 with extension 79 are not used.

Figure 5:
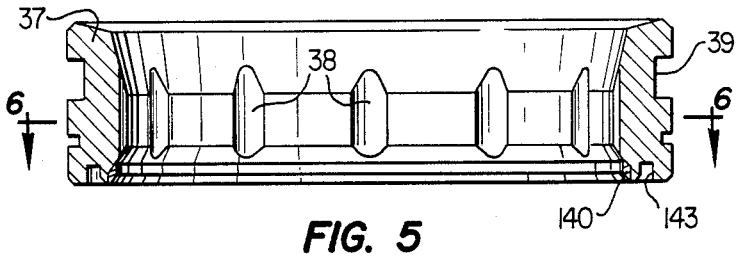
FIG. 5 is an enlarged view in section sowing the valve seat and flow channels.
Figure 6:
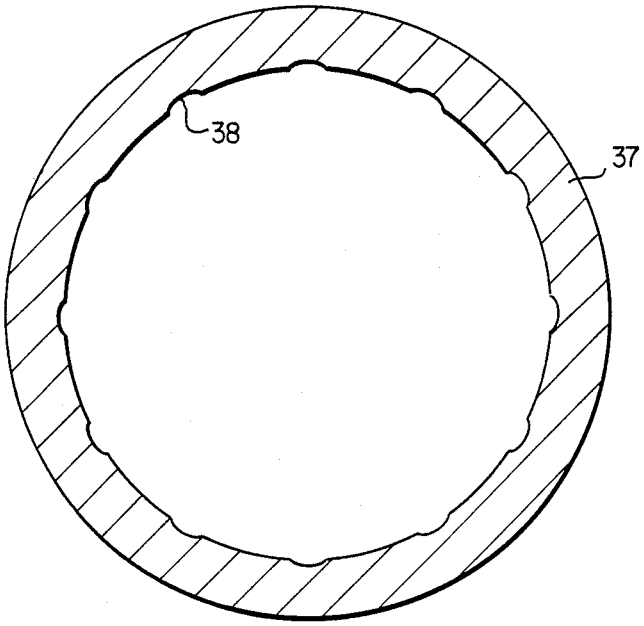
FIG. 6 is a drawing in section taken along line 6—6 of FIG. 5.
Figure 7:
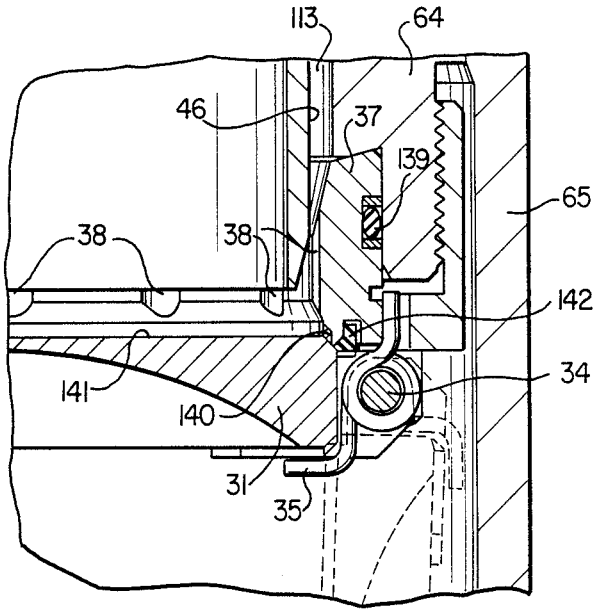
FIG. 7 is an enlarged view in section with portions broken away showing the flow channels between the lower portion of the operator tube and the valve seat.

For ease of manufacture and assembly, valve seat 37 is manufactured as a separate component and inserted into housing subassembly 64. Valve seat 37 could be machined as part of housing subassembly 64 within longitudinal bore 67. Valve seat 37 as shown in FIGS. 5 and 6 has a circular cross section. O-ring groove 39 is provided on its exterior to receive O-ring 139 therein to prevent fluid flow between the exterior of valve seat 37 and housing subassembly 64.

Valve seat 37 has a hardened surface 140 to form a metal-to-metal fluid seal with matching surface 141. Copolymeric or resilient seal means 142 is carried by valve seat 37 in recess 143 to provide a backup fluid seal when valve closure means 31 is in its second, closed position. An important feature of valve seat 37 is flow channels 38 machined on the inside diameter thereof. Depending upon the construction of valve seat 37, flow channels 38 could be machined directly into housing subassembly 64. Hardened metal seating surfaces 140 and 141 are particularly desirable when valve closure means 31 is subjected to slam closure. Resilient seal means 142 is particularly beneficial for providing a fluid tight barrier at low pressures.

Sand or Debris Control

Figure 3:
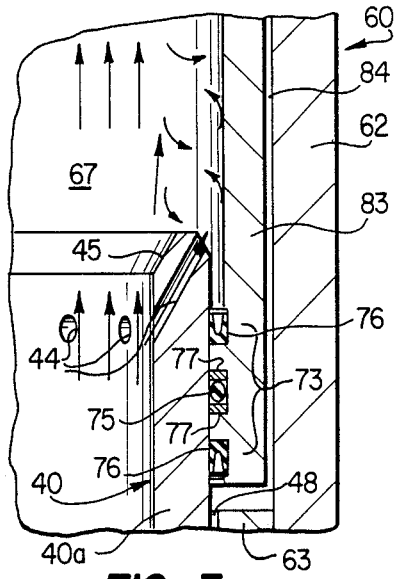
FIG. 3 is an enlarged drawing of the upper end of the operator tube in section with portions broken away of one embodiment of the present invention.

Sand or other debris, contained in the well fluids, has a tendency to settle out or accumulate in areas of low fluid flow velocity. Examples of such areas are the top of operator tube 40 when safety valve 30 is open and spring chamber 53. A plurality of small ports or flow nozzles 44 extend through upper end 45 of operator tube 40. Flow nozzles 44 are machined at an acute angle relative to the longitudinal axis of operator tube 40 and are evenly spaced around the circumference of end 45. As best shown in FIG. 3, a portion of the well fluids flowing through operator tube 40 will exit via flow nozzles 44 and create turbulent flow within housing means 60 adjacent thereto. Turbulent flow at this location tends to scour the inside diameter of cylinder 83 and to prevent debris accumulation on top of seal means 73. The number, size, and acute angle associated with flow nozzles 44 can be varied to accommodate the internal dimensions of safety valve 30 and the characteristics of the well fluids flowing therethrough.

Another potential area to accumulate debris is in the annulus between the inside diameter of housing means 60 and the outside diameter of operator tube 40. Stationary seal means 73 and piston seal means 70 block well fluid flow through control fluid chamber 48. Coupling means 90 with ring 99 blocks well fluid flow between the ends of operator tube sections **40*b* and 40*c* When safety valve 30 is in its full open position as shown in FIG. 8, lower end 49 of operator tube 40 contacts taper shoulder 69 to form a fluid barrier therewith. Thus the present invention minimizes the entrance points for well fluids to carry debris into the annulus between operator tube 40 and housing means 60**.

Spring chamber 53 is generally filled with stagnate well fluid. During the opening and closing of valve closure means 31, spring 54 will expand and contract within spring chamber 53. This movement of spring 54 will result in some well fluid flow into and out of spring chamber 53. Flow path 110 is provided between the exterior of operator tube 40 and the interior of housing means 60 whereby longitudinal movement of operator tube 40 will discharge or flush debris accumulated therebetween. Flow path 110 is defined in part by annulus 111 below piston seal means 70, notches 112 in coupling means 90, spring chamber 53, and annulus 113 below spring chamber 53. An important portion of flow path 110 is defined by outside diameter 46 of operator tube section 40*d* and flow channels 38 in valve seat 37. The outside diameter 46 is substantially reduced as compared to the other portions of operator tube 40 and valve seat 37. Therefore, while operator tube 40 is moving valve closure means 31 from its closed position to its open position, well fluids and debris will be discharged from spring chamber 53 via flow channels 38. Fluid will exit from spring chamber 53 when valve closure means 31 is intermediate its first and second position. Reduced diameter 46 also minimizes the possibility of operator tube 40 damaging metal sealing surface 141 during slam closure of flapper 31.

Alternative Embodiments

The previous description has been directed towards an operator tube which opens a flapper type valve closure means. U.S. Pat. No. 3,860,066 to Joseph L. Pearce el al demonstrates that operator tube 40 could be modified to open and close ball type and poppet type valve closure means in addition to flapper 31. Therefore, the present invention is not limited to flapper valves.

The previous description has also been directed towards a safety valve which is opened and closed in response to a hydraulic fluid control signal from the well surface. The present invention can be used with any type of safety valve control signal including electrically operated valves such as shown in U.S. Pat. No. 3,731,742 to Phillip S. Sizer et al or U.S. Pat. No. 4,002,202 to Louis B. Paulos et al. The present invention is not limited to hydraulically controlled safety valves and may in fact provide sufficient reliability to make more complicated control systems commercially acceptable for downhole safety valves.

The preceding written description explains only some embodiments of the present invention. Those skilled in the art will readily see other modifications and variations without departing from the scope of the invention which is defined by the claims.

What is claimed is:

1. A safety valve for downhole use in well comprising:

a. housing means having a longitudinal bore extending therethrough;

b. valve closure means mounted in the housing means to control fluid flow through the longitudinal bore;

c. the valve closure means having a first position which allows fluid flow through the longitudinal bore and a second position which blocks fluid flow therethrough;

d. an operator tube in the housing means to shift the valve closure means from its second position to its first position;

e. means for moving the operator tube in response to a control signal from the well surface;

f. a plurality of small ports extending through the upper end of the operator tube; and g. the small ports defining an acute angle relative to the longitudinal axis of the operator tube whereby fluid flow is directed to clean the interior of the housing means adjacent thereto.

2. A safety valve as defined in claim 1 further comprising:

a. the operator tube having a reduced outside diameter portion near its lower end; and b. a plurality of flow channels in the housing means adjacent to the reduced outside diameter portion to partially define a fluid flow path therebetween.

3. A safety valve as defined in claim 1 further comprising:

a. a lockout sleeve in the housing means above the operator tube;

b. the lockout sleeve having a first position which does not restrict movement of the valve closure means between its first and second positions and a second position which holds the valve closure means in its first position; and c. the small ports directing fluid flow against the interior of the housing means below the lockout sleeve and above the operator tube.

4. A safety valve in accordance with claim 1 wherein the operator tube comprises:

a. at least two sections concentrically aligned with the longitudinal bore;

b. means for connecting adjacent sections to each other to facilitate longitudinal movement within the longitudinal bore; and c. the connecting means including a barrier to restrict fluid flow from the longitudinal bore between adjacent ends of the sections.

5. A safety valve as defined in claim 1 wherein the means for moving the operator tube comprise a piston seal means.

6. A safety valve as defined in claim 5 wherein the piston seal means comprises:

a. center element;

b. a cup type seal element on opposite sides of the center element; and c. a ring adjacent to each cup type seal element with a portion of each ring projecting into its respective cup type seal element.

7. A surface controlled subsurface tubing supported well safety valve comprising:

a. tubular housing means having a longitudinal bore therethrough and means at opposite ends for connecting the housing means in a well tubing string to form a portion thereof;

b. valve closure means mounted in the housing means to control fluid flow through the longitudinal bore;

c. the valve closure means having a first position which allows fluid flow through the longitudinal bore and a second position which blocks fluid flow therethrough;

d. an operator tube in the housing means to shift the valve closure means from its second position to its first position;

e. the operator tube having first and second positions which correspond respectively to the first and second positions for the valve closure means;
f. piston means for moving the operator tube and valve closure means to their first positions;
g. means for biasing the operator tube its second position and the valve closure means to its second position;
h. the operator tube having a reduced outside diameter portion near its lower end; and
i. a plurality of flow channels in the housing means adjacent to the reduced outside diameter portion to partially define a fluid flow path and to clean out any debris therebetween.

8. A safety valve as defined in claim 7 wherein the operator tube further comprises a plurality of flow nozzles extending through the upper end of the operator tube.

9. A safety valve as defined in claim 7 wherein the operator tube further comprises:
a. at least two sections concentrically aligned with the longitudinal bore;
b. means for connecting adjacent sections to each other to facilitate longitudinal movement within the longitudinal bore; and
c. the connecting means including a barrier to restrict fluid flow from the longitudinal bore between adjacent ends of the sections.

10. A safety valve as defined in claim 7 wherein the piston means comprises:
a. center element;
b. a cup type seal element on opposite sides of the center element; and
c. a ring adjacent to each cup type seal element with a portion of each ring projecting into its respective cup type seal element.

11. A surface controlled subsurface tubing supported well safety valve comprising:
a. tubular housing means having a longitudinal bore therethrough and means at opposite ends for connecting the housing means in a well tubing string to form a portion thereof;
b. valve closure means mounted in the housing means to control fluid flow through the longitudinal bore;
c. the valve closure means having a first position which allows fluid flow through the longitudinal bore and a second position which blocks fluid flow therethrough;
d. an operator tube in the housing means to shift the valve closure means from its second position to its first position;
e. the operator tube having first and second positions which correspond respectively to the first and second positions for the valve closure means;
f. piston means for moving the operator tube and valve closure means to their first positions;
g. means for biasing the operator tube to its second position and the valve closure means to its second position;
h. the operator tube having a reduced outside diameter portion near its lower end;
i. a plurality of flow channels in the housing means adjacent to the reduced outside diameter portion to partially define a fluid flow path therebetween;
j. a plurality of flow nozzles extending through the upper end of the operator tube; and
k. the flow nozzles defining an acute angle relative to the longitudinal axis of the operator tube.

12. A surface controlled subsurface tubing supported well safety valve comprising:
a. tubular housing means having a longitudinal bore therethrough and means at opposite ends for connecting the housing means in a well tubing string to form a portion thereof;
b. valve closure means mounted in the housing means to control fluid flow through the longitudinal bore;
c. the valve closure means having a first position which allows fluid flow through the longitudinal bore and a second position which blocks fluid flow therethrough;
d. an operator tube in the housing means to shift the valve closure means from its second position to its first position;
e. the operator tube having first and second positions which correspond respectively to the first and second positions of the valve closure means;
f. piston means for moving the operator tube and valve closure means to their first positions;
g. means for biasing the operator tube to its second position and the valve closure means to its second position;
h. the operator tube having a reduced diameter portion near its lower end;
i. a plurality of flow channels in the housing means adjacent to the reduced outside diameter portion to partially define a fluid flow path therebetween;
j. a plurality of flow nozzles extending through the upper end of the operator tube;
k. a lockout sleeve in the housing means above the operator tube;
l. the lockout sleeve having a first position which does not restrict movement of the valve closure means between its first and second positions and a second position which holds the valve closure means in its first position; and
m. the flow nozzles directing fluid flow against the interior of the housing means below the lockout sleeve and above the operator tube.

13. A method of designing and operating a surface controlled subsurface safety valve, having a housing means, a valve closure means, and an operator tube longitudinally slidable within the housing means to control opening and closing of the valve closure means, to minimize the accumulation of deposits within the safety valve from well fluids flowing therethrough comprising:
a. machining a plurality of small ports through the upper end of the operator tube at an acute angle relative to the longitudinal axis of the operator tube whereby a portion of the well fluids flowing through the operator tube will exit via the small ports to create turbulent flow within the housing means adjacent thereto; and
b. establishing a flow path between the exterior of the operator tube and the interior of the housing means whereby longitudinal movement of the operator tube to open the valve closure means can discharge any debris accumulated between the operator tube and housing means.

14. The method of claim 13 further comprising the step of establishing a fluid barrier between sections of the operator tube to minimize entrance points for debris from the longitudinal bore to accumulate between the operator tube and the housing means.

15. The method of claim 14 further comprising the step of joining sections of the operator tube with a flexible coupling which minimizes stress on the operator tube from slam closure of the valve closure means.

16. A surface controlled subsurface tubing supported well safety valve comprising:

a. tubular housing means having a longitudinal bore therethrough and means at opposite ends for connecting the housing means in a well tubing string to form a portion thereof;

b. valve closure means mounted in the housing means to control fluid flow through the longitudinal bore;

c. the valve closure means having a first position which allows fluid flow through the longitudinal bore and a second position which blocks fluid flow therethrough;

d. an operator tube in the housing means to shift the valve closure means from its second position to its first position;

e. the operator tube having first and second positions which correspond respectively to the first and second positions for the valve closure means;

f. means for biasing the operator tube to its second position and the valve closure means to its second position;

g the operator tube having a reduced outside diameter portion near its lower end; and h. a plurality of flow channels in the housing means adjacent to the reduced outside diameter portion to partially define a fluid flow path and to clean out any debris therebetween.

17. A safety valve as defined in claim 16 wherein the operator tube further comprises a plurality of flow nozzles extending through the upper end of the operator tube.

18. A safety valve as defined in claim 16 wherein the operator tube further comprises:

a. at least two sections concentrically aligned with the longitudinal bore;

b. means for connecting adjacent sections to each other to facilitate longitudinal movement within the longitudinal bore; and c. the connecting means including a barrier to restrict fluid flow from the longitudinal bore between adjacent ends of the sections.

19. A surface controlled subsurface tubing supported well safety valve comprising:

a. tubular housing means having a longitudinal bore therethrough and means at opposite ends for connecting the housing means in a well tubing string to form a portion thereof;

b. valve closure means mounted in the housing means to control fluid flow through the longitudinal bore;

c. the valve closure means having a first position which allows fluid flow through the longitudinal bore and a second position which blocks fluid flow therethrough;

d. an operator tube in the housing means to shift the valve closure means from its second position to its first position;

e. the operator tube having first and second positions which correspond respectively to the first and second positions for the valve closure means;

f. means for biasing the operator tube to its second position and the valve closure means to its second position;

g. the operator tube having a reduced outside diameter portion near its lower end; and h. a plurality of flow channels in the housing means adjacent to the reduced outside diameter portion to partially define a fluid flow path therebetween;

i. a plurality of flow nozzles extending through the upper end of the operator tube with the flow nozzles defining an acute angle relative to the longitudinal axis of the operator tube.

* * * * *